United States Patent [19]

Surko, Jr.

[11] Patent Number: 4,920,773

[45] Date of Patent: May 1, 1990

[54] DOOR LOCK HAVING DISENGAGES OUTER LEVER HANDLE WHEN IN THE LOCKED CONDITION AND MEANS TO BIAS THE HANDLE TOWARD HORIZONTAL POSITION

[75] Inventor: Walter E. Surko, Jr., Southington, Conn.

[73] Assignee: Yale Security Inc., Monroe, N.C.

[21] Appl. No.: 153,215

[22] Filed: Feb. 8, 1988

[51] Int. Cl.[5] ..... E05B 13/10

[52] U.S. Cl. ..... 70/224; 70/472; 70/149; 292/352

[58] Field of Search ..... 70/223, 224, 218, 149, 70/222, 209, 472, 489; 292/352, 359, 336.3, 347, 348

[56] References Cited

U.S. PATENT DOCUMENTS

| | | | |
|---|---|---|---|
| 1,834,223 | 12/1931 | Rymer | 70/472 |
| 2,062,598 | 12/1936 | Nelson | 70/472 |
| 2,175,791 | 10/1939 | Brauning | 70/472 |
| 2,197,508 | 4/1940 | Peo | 292/352 |
| 2,634,598 | 4/1953 | Kaiser | 70/149 |
| 2,672,041 | 3/1954 | Heyer | 70/223 |
| 3,718,015 | 2/1973 | Tornoe et al. | 292/352 X |
| 3,856,339 | 12/1974 | Tornoe et al. | 292/352 X |
| 3,881,331 | 5/1975 | Tranberg et al. | 70/218 X |
| 3,896,644 | 7/1975 | Nagy et al. | 70/149 |
| 3,922,896 | 12/1975 | Kagoura | 70/223 |
| 4,108,482 | 8/1978 | Dietrich et al. | 70/149 X |
| 4,333,324 | 6/1982 | Dietrich et al. | 70/472 X |
| 4,429,556 | 2/1984 | Kambic | 70/472 X |
| 4,437,695 | 3/1984 | Foshee | 292/352 |
| 4,631,944 | 12/1986 | Gater et al. | 70/149 X |
| 4,648,639 | 3/1987 | Martin et al. | 70/472 X |
| 4,655,059 | 4/1987 | Best et al. | 70/224 |
| 4,660,395 | 4/1987 | Huang et al. | 70/223 X |
| 4,672,829 | 6/1987 | Gater et al. | 70/472 |

*Primary Examiner*—Robert L. Wolfe
*Assistant Examiner*—Suzanne L. Dinoe
*Attorney, Agent, or Firm*—Dallett Hoopes

[57] ABSTRACT

A drive element in this lock pushes a radially directed outward finger out of its longitudinal slot in the outer tubular spindle to disengage the outer handle from the latch so that the handle free-wheels. Spring means in the outer handle rose returns the handle to its normal horizontal position when the handle is released. The handle is preferably in lever form.

14 Claims, 4 Drawing Sheets

DOOR LOCK HAVING DISENGAGES OUTER LEVER HANDLE WHEN IN THE LOCKED CONDITION AND MEANS TO BIAS THE HANDLE TOWARD HORIZONTAL POSITION

BACKGROUND OF THE INVENTION

1. Field of the Invention

This invention relates to a lock in which the outer handle is preferably in lever form and which "free-wheels" when the lock is in locked condition. More specifically, in such a lock the free-wheeling characteristic is effected by ordinary means such as pushing a button or turning a key.

2. Description of the Prior Art Including Information Disclosed in § 1.97-1.99

In the prior art there are showings of locks in which a clutch may be disengaged by manipulation of the inner handle so that the outer handle, in knob form, may be free to rotate when the clutch is disengaged. Such arrangements, however, do not give assurance that the lock stays locked. Further there has been no provision that the handle be in the form of a lever, which, when released, is automatically returned to its normal horizontal position.

Examples of the prior art are shown in U.S. Pat. No. 2,634,598, which issued Apr. 14, 1953 to Fred Kaiser, and U.S. Pat. No. 3,922,896, which issued Dec. 2, 1975 to T. Kaoura. (Copies are enclosed in accordance with 37 CFR 1.97-1.99.)

SUMMARY OF THE INVENTION

Under the present invention, the inner handle is provided with a manipulator for an internal pushpiece which blocks further rotation of the outer tubular spindle by keying it to a stationary boss. At the same time, the pushpiece drives a finger inside the outer handle outward longitudinally from its normal position in a longitudinal slot in the outer tubular spindle. The outer end of the finger, which is always engaged in a keyway in the outer handle, is, after such longitudinal displacement, disposed in a circumferential space outward of the spindle so that when the outer handle, in lever form, is turned, the finger and its mount are rotated but disengaged from the tubular spindle to permit free-wheeling of the handle. At the same time, spring means, preferably in the form of a horseshoe-shaped spring in the rose for the outer handle, is arranged to return the lever handle to its normal position when it is released.

BRIEF DESCRIPTION OF THE DRAWINGS

Other objects and features of the invention will be apparent from the following specification including drawings, all of which describe a non-limiting embodiment of the invention. In the drawings.

DESCRIPTION OF THE PREFERRED EMBODIMENT

Figures 1, 2, 2A:
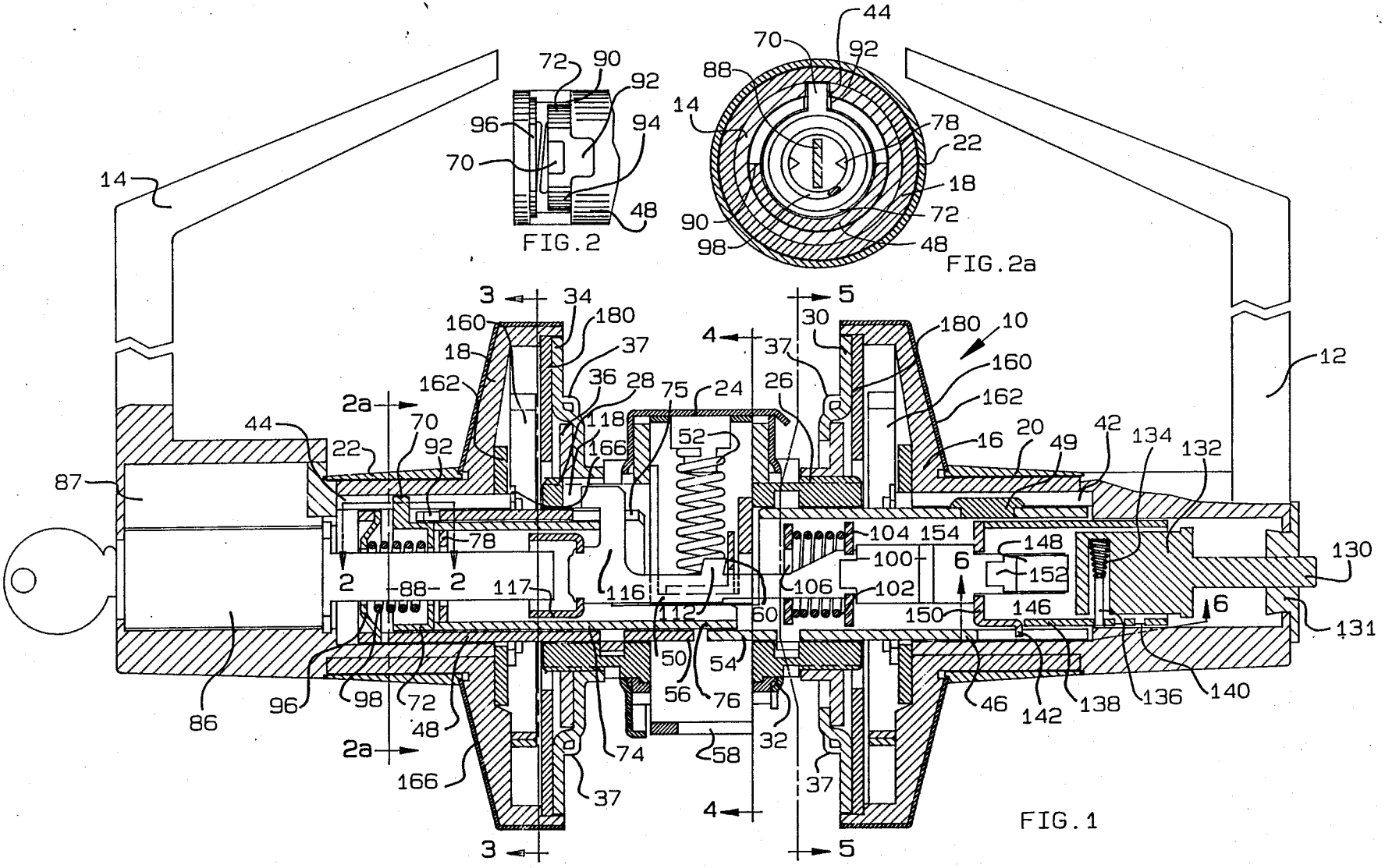
FIG. 1 is a sectional view of a lock embodying the invention with handles partly shown in profile.
FIG. 2 is a sectional view taken on the line 2—2 of FIG. 1.
FIG. 2*a* is a sectional view taken on the line 2*a*-2*a* of FIG. 1

In FIG. 1 a lock embodying the invention is generally designated 10. It comprises an inner handle 12 and an outer handle 14. The handles are in lever form. The inner handle is provided with a rose 16 and the outer handle is provided with a rose 18. The roses are each provided with a cover or "scalp" and a sleeve. The inner sleeve 20 is shaped to flow into the stem of the inner handle 12 and the outer sleeve 22 is similarly shaped.

A latch housing 24 is disposed intermediate the two handles, and its opposite ends are fixedly mounted on the inner threaded boss 26 and the outer threaded boss 28 respectively. An inner mounting plate 30 is provided and is held inward toward the door by the nut 32, which has a central threaded sleeve portion threadedly engaging the boss 26. The outer mounting plate 34 is held against the door by its threaded flange 36, which threadedly engages the threaded boss 28. In installation the nut 32 is tightened to force the tabs 37 into the specially formed notches in the lock opening in a metal door to both firmly sandwich the door between the parts and prevent rotation of the lock.

The outer mounting plate 34 is formed with a cylindrical interiorly threaded boss which extends inward of the door. The mounting plate 30 may be formed with spaced countersunk apertures and the outer rose 18 has threaded cylindrical bosses 31 so that threaded fastener means (not shown) can be used to hold the plate 30 and rose 18, preventing rotation of the lock in a wooden door.

The shanks of the respective handles 12 and 14 are provided with interior keyways 42 and 44 respectively, and the inner shank telescopes over the inner tubular spindle 46 journaled to rotate in the boss 26, while the outer handle contains the outer tubular spindle 48 which rotates in boss 28. Key 49 mounted in an opening in the tubular spindle 46 extends into keyway 42 to link the two parts for rotation together.

Figure 4:
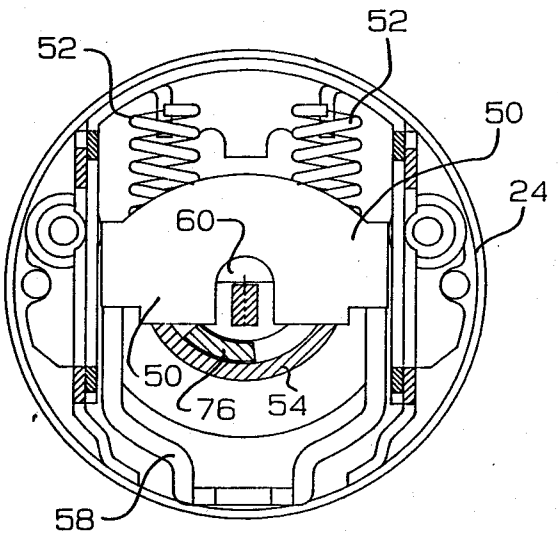
FIG. 4 is a sectional view taken on the line 4—4 of FIG. 1.

Latch housing 24 is provided with a customary retractor 50, which is spring-pressed downward (FIG. 1) by a pair of side-by-side springs 52 mounted in conventional fashion and held in compression between their mountings at the top of housing 24 and the retractor 50. As shown best in FIG. 1, the two tubular spindles are formed with arcuate pull-back ends 54 and 56 so that when either of the spindles is rotated by its respective handle, the end of the pull-back forces the retractor 50 upward, as viewed in FIG. 4, to draw the latch actuator 58 inward, disengaging the latch, not shown. The retractor 50 is also provided with a catch retainer 60, having a flange under the springs 52 and which raises with the retractor 50 for purposes to be described.

Disposed in the keyway 44 (FIG. 2*a*) of the outer handle is the distal end of a radial finger 70. The finger 70 is formed at the outer end of a cup-shaped element 72, which rides inside the leftward end (FIG. 1) of the outer tubular spindle 48. The rightward end of the cup-shaped element 72 butts against the end depressor 74, which is disposed inside the outer tubular spindle 56. At its rightward end the outer tubular spindle 56 is formed with a longitudinal dogging slot 75.

Figure 3:
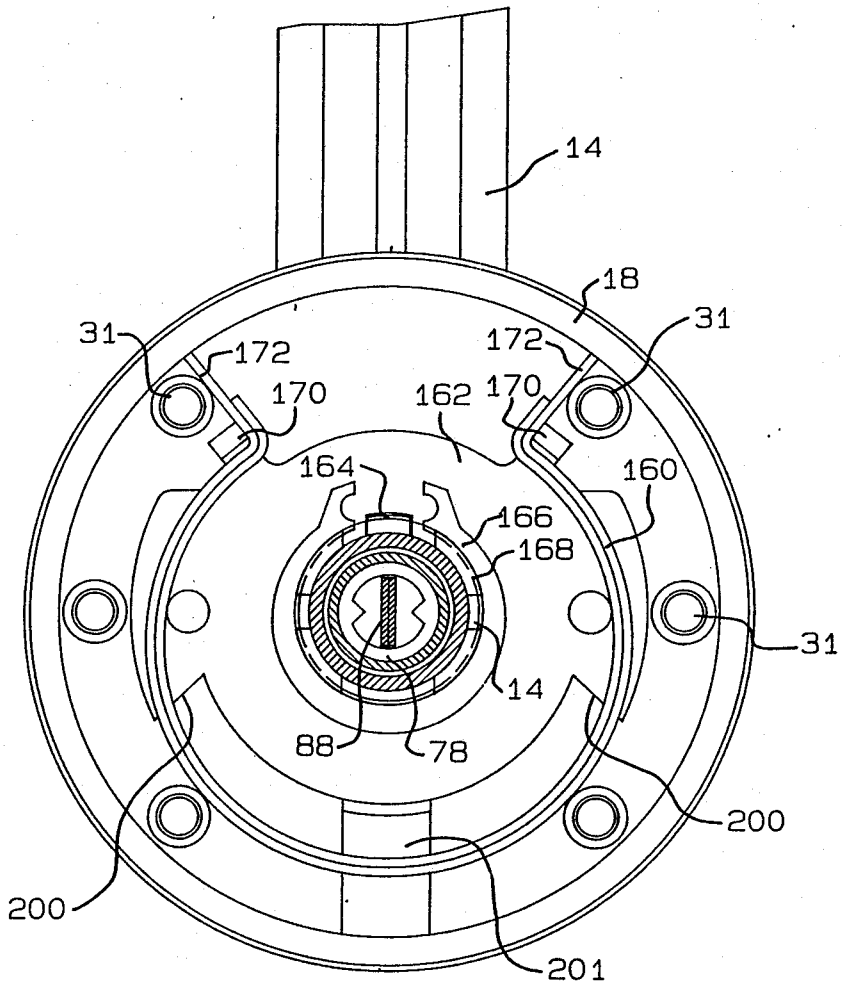
FIG. 3 is a sectional fragmentary view taken on the line 3—3 of FIG. 1.

At its rightward end the depressor 74 is formed with an arcuate latch-retractor-raising scoop 76 disposed under the retractor 50, and in its leftward end the depressor 74 mounts a fixed closure plate 78 with an irregular opening 80 therein (FIG. 3).

Central of the outer handle 14 a key cylinder 86 having a bible 87 is provided. The bible 87 is keyed into an opening in the shank of handle 14. The cylinder has a flat operating tail 88. The tail extends through a circular opening in the rightward end of the cup-shaped element 72 and into the odd-shaped opening 80 of the end plate 78 (FIG. 3).

The outer tubular spindle is slotted, as best shown in FIG. 2, at 90. The slot includes a relatively narrow longitudinal portion 92 adapted to receive the finger 70, and a circumferential slot or space 94 which extends laterally with respect to the longitudinal portion 92. A dish-shaped retainer 96 having a circular cutout therein which passes the tail 88 is disposed in the circumferential portion 90 of the slot and butts against the leftward margins of the slot.

A spiral spring 98 loosely surrounds the tail 88 and is disposed between the rightward wall of the cup-shaped element 72 and the dish-shaped retainer 96 to urge the cup-shaped element 72 and finger 70 rightward so that in operative condition of the handle 14, the finger 70 is disposed in slot 92 and extends outward to keyway 44 to key together the outer tubular spindle 48 and the shank of the outer handle 14. On the other hand, when the finger 70 is in the position shown, rotation of the handle 14 will merely turn the finger 70, but not the tubular spindle, because the inward portion of the finger 70 is free to move in the space 90 when the handle is turned.

Figure 5:
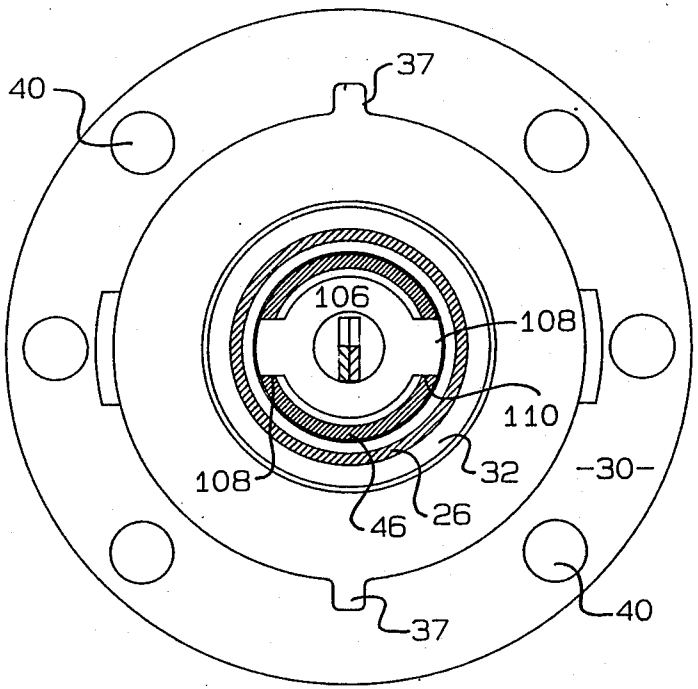
FIG. 5 is a sectional view taken on the line 5—5 of FIG. 1.

Disposed inside the inner tubular spindle 46 and the outer tubular spindle 48 and release tube 74 is a pushpiece 100. This piece is biased to the right, as shown in FIG. 1, by a spring 102, which is sandwiched between a washer 104 disposed in notches in the pushpiece, and the apertured disc 106, which has ears (FIG. 5) 108 which fixedly mount it in appropriate openings 110 in the inner tubular spindle 46.

The pushpiece is provided with a catch 112, which has an inclined left edge and snaps past catch retainer 60, free to raise against the springs 52 when the piece 100 is pushed leftward. Once it is in the position shown in FIG. 1, it is held in that leftward position and the dog 116, which is offset, extends into the dog slot 75 in the outer tubular spindle 48 and into a slot 118 in the threaded boss 28. This locks the outer tubular spindle from rotation. At the same time, the dog 116 pushes the release element 74 to the left to move the finger 70 out of the longitudinal portion 92 of the slot in the tubular spindle and into the space 90 to permit the outer handle 14 to free-wheel. On its leftward end (FIG. 1) the pushpiece is provided with the stabilizing cup 117.

A pushpiece manipulator is provided centrally in the stem of the inner handle 12. It comprises a flat thumbpiece 130 which extends through a rotary cover 131 disposed in an opening in the end of the shank of handle 12. The thumbpiece is an extension of an integral drum 132, which is formed with a radial pocket 134 housing a spring-pressed pin 136. A tubular housing 138 journals the drum 132 for rotation as the thumbpiece 130 is turned, and the pin 136, extending through one of a selected opening 140 spaced longitudinally along the housing 138, keys the housing 138 for rotation with the drum 132.

Figure 6:
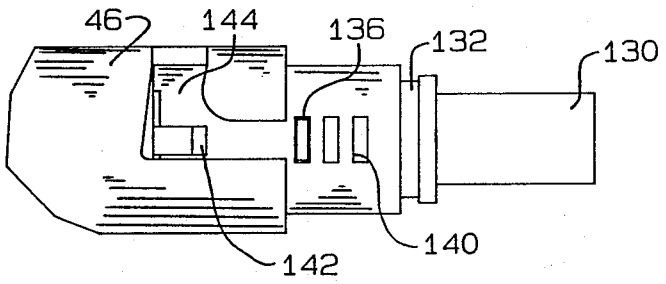
FIG. 6 is a sectional view taken on the line 6—6 of FIG. 1.

An outwardly struck tongue 142 is provided in the housing and slides in a roughly L-shaped opening 144 (FIG. 6) in the outer tubular spindle 46. The leftward end of the manipulator housing 138 is formed with a circular aperture 146. This aperture 146 receives the end of a reduced tongue 148 of the pushpiece 100 and makes possible the rotation of the housing 138 without the rotation of the pushpiece 100. Shoulders 150 on the pushpiece assure that the leftward movement of the manipulator 130 (FIG. 1) will result in the leftward movement of the entire pushpiece 100, release tube 74, cup-shaped element 72 and, finally, finger 70. A speed clip 52 on the end of the reduced tongue 148 holds the housing on the tongue.

As shown best in FIG. 3, means for returning the handle 14 to horizontal position after release are disposed in the rose 18 and comprise a horseshoe-shaped pair of springs 160. These springs are positioned against a stop plate 162, which is keyed to the shank of outer handle 14 by a projection 164 (FIG. 3) and held against the inside of the rose by a spring retainer 166, which snaps into a groove 168 in the end of the shank of handle 114. Stop plate 162 therefore turns with the shank. Disposed on the stop plate 162 is a pair of spaced lugs 170, which extend perpendicular to the stop plate in a direction toward the latch housing 24. These lugs 170 embrace the two radially deflected ends 172 of the spring 160.

As shown in FIG. 3 and described, the rose is formed with a plurality of spaced cylindrical bosses 31, which are internally threaded and aligned with openings 40 in plate 30. Two of the bosses 31 are radially aligned with the lugs 170 when the handle 14 is in normal position. As shown, the radial ends 172 of the spring 160 extend outward to also be engaged or embraced by the outward surfaces of the ends by the adjacent bosses 31.

As a result of this structure, when the handle 14 is turned the stop plate 162 will turn also, and, depending on the direction of rotation, one of the lugs 170 will approach the opposite boss 31, flexing further the springs 160. Upon release of the handle 14 the springs 160 will restore the bracket and handle 14 to its normal position as the ends 172 take the position shown in FIG. 3.

As shown in FIG. 3, stop plate 162 has shoulders 200 which engage a stop projection 201 to establish maximum rotation of the handle 14.

Spring 160 in the rose 18 and its related shape, stop plate 162 and its retaining means, and bosses 174 are all duplicated inside the rose 16 wherein the spring is designated 160'. The springs 160 and 160' are provided with apertured cover plates 180 and 180'.

Anchor pins (not shown) extend inwardly from the mounting plates 34, 36 to hold the latch housing 24 from rotating.

SUMMARY OF OPERATION

In operation, the lock of the invention is invariably locked from the inside by pushing the manipulator 30 in so that the push-piece 100 moves leftwardly until the catch 112 snaps past and behind the catch retainer 60. In this position, as shown in FIG. 1, the dog 116 fits into the locking slot 76 of the outer tubular spindle 48 and into the slot 118 in the threaded boss 28. This locks the outer tubular spindle from rotation. At the same time, the dog 116 presses the release tube 74 leftwardly to move the finger 70 out of its slot 92 (FIG. 2) in the tubular spindle 48. This permits the free-wheeling of the outer handle 14 whereby the handle may be rotated 60 degrees against the force of the spring 160 until the projection 200 on stop plate 162 contacts lug 201. Upon being released, the handle 14 will be returned to its normal horizontal position by the spring 160.

In the semi-locked condition described above, the door may be unlocked from the outside by a key in the cylinder 86. Rotation of the cylinder barrel causes rotation of the tongue 88 in the odd-shaped opening of the plate 78 (FIG. 3). Plate 78, being staked to the depressor tube 74, causes rotation of the scoop 76 (FIG. 5) to raise the retractor along with the catch retainer 60. Raising of the retractor causes the latch actuator 58 to move inwardly, unlatching the door. At the same time, because the catch retainer 60 is raised, the catch 112 escapes to the right, permitting the dog 116 to move to the right also. The rightward movement of the dog 116 also permits the rightward movement of the release tube 74, which permits the finger 70 to move rightwardly into its longitudinal slot 92. From this moment the door is thereafter unlocked from the outside and handle 24 is operated to unlatch the door.

All during this time the inner handle 12, keyed to the inner tubular spindle 46 as at 42, 43, is operable to raise the retractor 50 by means of the arcuate pull-back 54.

For more permanent locking of the door the manipulator 130 may be pressed in and turned so that the tongue 142 (FIG. 6) rides into the circumferential slot 144 of its opening. This holds the manipulator 130 inward, pressing the pushpiece 100 to the left against spring 102.

While actually in this process the catch 112 snaps past catch retainer 60, this is not important because tongue 142 holds the pushpiece 100 leftwardly even after the raising of the retractor 50. The pushpiece 100 will subsequently be permitted to move to the right only after the manipulator 130 has been turned so that tongue 142 is free to move longitudinally in the longitudinal portion of slot 144.

During the permanent locking described above wherein the manipulator 130 is pushed in and turned, the locking operation with respect to dog 116 and finger 70 is the same as in the semi-lock condition.

Clearly, during the time the lock is fully locked even though the latch may be withdrawn by the turning of the handle 12 from the inside, or turning of the key in the cylinder 86, there is no rightward movement of dog 116, and hence, the lock is still in locked condition.

When the lock is unlocked, handles 12 and 14, working respectively through the tubular spindles 46 and 48 and their arcuate ends 54 and 56, can raise the retractor 50 against the springs 52 to unlatch the door.

MODIFIED FORM OF THE INVENTION

A modified form of the invention is disclosed in FIGS. 7 through 12. This form finds use, for instance, in a school classroom wherein the inner handle is always operative and the outer handle can be locked and unlocked by key only.

Figure 7:
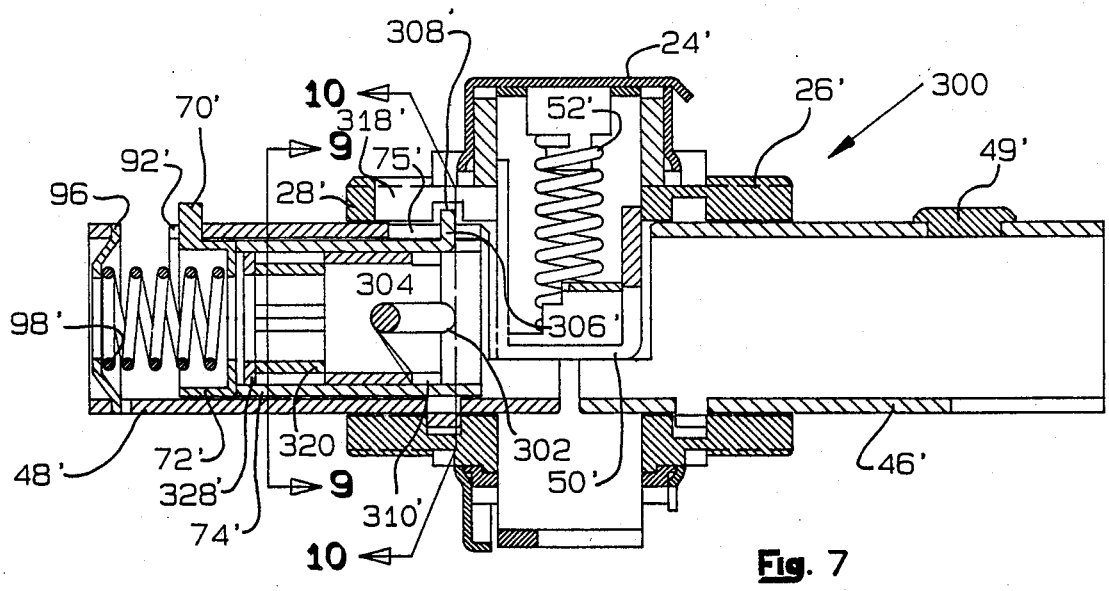
FIG. 7 is a sectional view of the latch mechanism and tubular spindles and related parts of a modified form of the invention.
Figure 8:
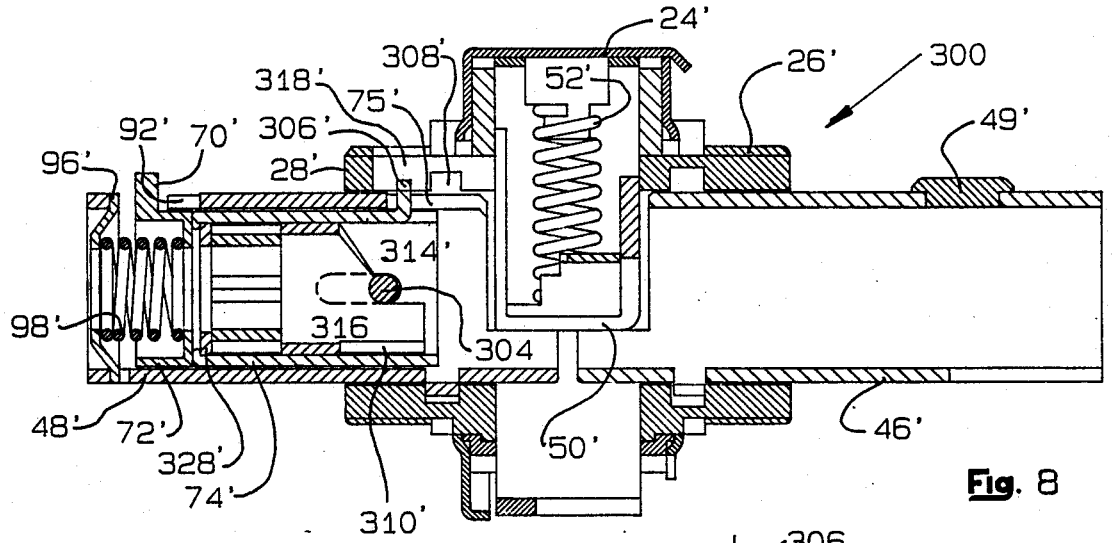
FIG. 8 is a sectional view comparable to FIG. 7 but showing the modified form with the outer handle disengaged.
Figure 9:
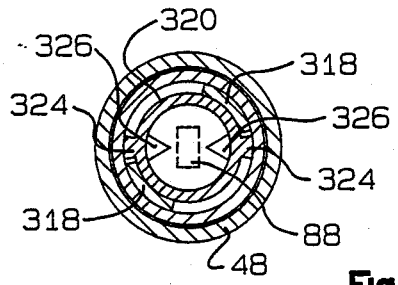
FIG. 9 is a sectional view taken on the line 9—9 of FIG. 7.
Figure 10:
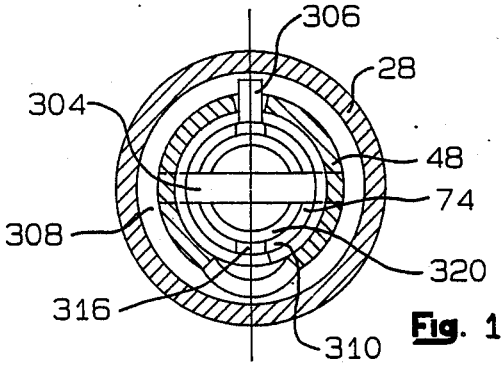
FIG. 10 is a sectional view taken on the line 10—10 of FIG. 7.
Figure 11:
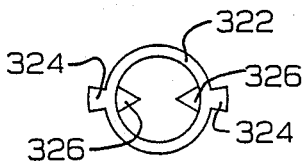
FIG. 11 is an end view of the cam tube driver.

For convenience and to avoid repetition, the primed form of the same reference numerals is used in FIGS. 7 through 12 to represent the same element as in the earlier described embodiment. FIGS. 7 and 8 show only the tubular spindles and latch housing of the modified form, it being understood that the handles, roses and other parts are similar to the version shown in the earlier figures.

The modified embodiment is designated 300 in FIG. 7 and comprises latch housing 24' mounted by the threaded bosses 26' and 28' with hardware similar to that shown in FIG. 1. Disposed for rotation in the bosses are the inner tubular spindle 46' and the outer tubular spindle 48'. The inner spindle can be turned by a handle (not shown) which is keyed by 49', and turning the handle raises the retractor 50' against the force of springs 52', as described earlier.

The outer tubular spindle 48' is provided inside with the cup element 72' having the finger 70' extending out the opening 92, as shown. The finger 70' is adapted to key into the keyway 44, as in the earlier embodiment. A spring 98' is held in compression between the cup-shaped element 72' and the retaining disc 96'. A release tube 74' is disposed inside the spindle 48' and is slotted as at 302 to receive a pin 304 fixedly disposed across the release tube. The release tube is formed with an upwardly struck ear 306 which moves in the slot 75' in the spindle. Note that when the outer handle is unlocked (FIG. 7), the end of the ear 306 is in the annular groove 308 in the boss 28', and when the outer handle is locked, the ear 306 is disposed in the slot 75' and also in a slot 118' in the boss 28', immobilizing the spindle.

As in the earlier embodiment, when the outer handle is locked, the finger 70' is moved leftwardly (FIG. 7) out into the circumferential part of opening 90' so that the turning of the handle (not shown) turns the finger 70' and the cup 72' but does not turn the spindle 48'.

In the classroom function version now described, the finger 70' and cup 72', as well as the release tube 74', are biased rightwardly (FIGS. 7 and 8) by the spring 98'. In the rightward position the finger 70' is keyed to the spindle and the ear 306 may move circumferentially freely in the annular groove 308 in the boss.

Means for moving the release tube 74' and the finger 70' with cup 72' to the left comprise a cam tube 310 (FIG. 12) which includes a barrel 312 having a cam surface 314 and **314*a* and a landing surface 316. The barrel is formed with longitudinally extending spaced arcuate legs 318**.

Means for driving the cam tube 310 is the cam tube drive 320, which is a tubular element 322 (FIG. 11) having diametrically opposed outward longitudinal ridges 324. Aligned with the ridges and directed towards the axis of the tubular element 322, are inward points 326.

In assembly, the cam tube drive 320 is telescoped inside the arcuate legs 318 of the cam tube with the projections 324 in between the legs 318 in circumferential disposition. Because the projections 324 take up considerably less than the circumferential space between the legs 318, the rotation and counter-rotation of the drive 320 leaves considerable lost motion in the rotary directions.

The final element of the assembly is a cap 328 (FIGS. 7 and 8 which has ears (not shown) fitting into slots (not shown) in the left end of the release tube 74'. The end of the release tube to the left (FIGS. 7 and 8) of the cap 328 is staked over to hold the cap in firm non-rotary position with respect to the tube 74'. The spindle assembly, comprising the spindle 48', the release tube 74', the spring 98', the retainer 96', the cap 4328, the cam tube 310 and the cam tube 320, is assembled separately by loading the cam tube 310, drive 320 and cap 328 into the release tube 74', staking the cap 328 as described, and inserting the pin 304 into the spindle through the elongated opening 302 in the release tube. The release tube assembly is then inserted into the spindle from the right. Thereafter the cup 72' is inserted, as shown in FIG. 7, through the opening 90'. The spring 98' and retainer 96' are then put into place.

In the final assembly the subassemblies of FIGS. 7 and 8 are equipped, as shown in FIG. 1, with the roses, and the handle 14, including the cylinder 86 with its tail 88, is assembled over the outer spindle 48', the tail 88 extending into the drive 320. The key may then be inserted into the cylinder 86, and turned. For locking the assembly the key may be turned counterclockwise. After some rotary lost motion, the tail 88', as shown in dotted lines in FIG. 9, engages the points 326 of the drive and rotates it clockwise also.

Eventually, after some additional lost motion, the ridges 324 on the drive engage the legs 318 on the cam tube, rotating the latter and causing the cam surface 314 to bear against the stationary pin 304, driving the release tube assembly leftwardly till pin 304 nestles into land 316. This moves the cup 72' also leftwardly so that the finger 70' clears the radial notch of opening 92' and unkeys the finger from the rotary movement of the tubular spindle 48'. At the same time, the tongue 306 moves leftwardly from a nonblocking position aligned with annular groove 308 into the slot 318' in the boss 28', blocking the rotation of the spindle 48'.

The described arrangement absolutely locks the door from the outside and permits free-wheeling of the outside handle, which is preferably in lever form. At the same time, the inside handle is always operable, because the spindle 46' is free to turn and raise the latch retractor 50'.

Unlocking the door is much the same in reverse. The key is turned clockwise, which causes the tail 88 (FIG. 9) to eventually engage the points 326 and rotate them clockwise as well. This, of course, turns the drive 320 through considerable lost motion to eventually cause the ridges 324 to engage the legs 318 of the cam tube 310. Clockwise rotation of the cam tube moves the land 316 off the pin 304, and permits the tube to slide rightwardly as the stationary pin 304 moves down slope 314. This permits the release tube, as well as the driver, to move rightwardly by the spring 98'. Eventually two things happen. The tongue 306 moves into the clearance groove 308, freeing the tubular spindle 48' for rotation and the finger 70' moves into the notch part 92' of the opening. The finger 70' now keys the handle for rotation with the tubular spindle 48'.

The reason for all the lost motion in connection with the tail 88', the points 326, and also the projections 324 with respect to the legs 318, is that movement of the handle 14 must have no effect on the locked or unlocked condition of the lockset. In other words, movement of the outer handle 14 60° or so in one direction or another must not so rotate the tail 88' that it results in a movement of the cam tube 310 with respect to the tubular spindle 48'.

Thus, the invention can take the form of a classroom lockset wherein the lock can be controlled only by a key from the outside of the door. The invention may take many other forms, and changes in dimension, shape and arrangement of parts are possible. Thus, while the invention has been described in a preferred embodiment, it should be understood that the invention is not limited to the specific features of the preferred embodiment but is, instead, limited only by the boundaries of the following claim language and equivalents.

I claim:

1. A door lock comprising an inner handle, an outer handle in the form of a lever normally disposed horizontally and having a rose, a latch housing between the handles and containing a latch retractor, and first spring means biasing the retractor outwardly toward latched disposition, an inner and an outer tubular spindle receiving the respective handles and both terminating respectively inside the lock in arcuate pull-back scoops, the two scoops being aligned end-to-end and disposed against the side of the retractor opposite the first spring means and each being adapted when turned to move the retractor inwardly, the inside handle being keyed to the inner spindle, the outer spindle being notched out at its outer end, the notch comprising a longitudinal slot and an adjoining partial circumferential space, the outer spindle having thereinside a central boss having a radial finger and second spring means urging the boss inward toward the latch housing, the outside handle having a shank with a longitudinal interior keyway, the boss and finger normally disposed by the second spring means with the finger extending through the longitudinal slot and into the keyway to key the outer handle and the outer tubular spindle into unitary rotation with each other, and push-piece means terminating in an actuator central of the inner knob and extending through the outer and inner tubular spindles and adapted on depressing to engage and push the boss to move the radial finger into the circumferential space so that the outer handle is free to turn unkeyed from the outer spindle, releasable catch means for holding the push-piece means in the depressed condition, and third spring means disposed in the rose of the outer handle for biasing the outer handle toward its normal position.

2. A door lock as claimed in claim 1 wherein the outer handle has a central lock cylinder having an operator tail adapted when turned to trip the catch means.

3. A door lock as claimed in claim 1 wherein the third spring means is a horseshoe-shaped spring having radially deflected ends and circumposing the outer tubular spindle and the outer handle carries a radial bracket in the rose having spaced lugs embracing the radially deflected ends of the third spring means, and projections means on the rose generally radially aligned respectively with the lugs when the lever is in said normal position, the projection means also embracing the radially deflected ends and whereby when the handle is turned, the bracket rotates and flexes one end of the spring toward the other end so that when the handle is released, the third spring means returns the outer handle to normal position.

4. A door lock as claimed in claim 1 wherein a hub surrounds a tubular spindle of the outer handle and both said last-mentioned spindle and the hub are formed with longitudinal slots and the pushpiece means includes a radially disposed dog which when the pushpiece means is depressed is disposed in both of said last-mentioned slots to lock the outer tubular spindle from rotation.

5. A door lock comprising an inner handle, an outer lever handle having a rose and having a horizontal "home" position, a latch housing between the handles and containing a latch retractor, and first spring means biasing the retractor outwardly toward latched disposition, an inner and an outer tubular spindle receiving the respective handles and both terminating respectively inside the lock in arcuate pull-back scoops, the two scoops being aligned end-to-end and disposed against the side of the retractor opposite the first spring means and each being adapted when turned to activate the latch retractor, the inner handle being keyed to the inner spindle, the outer spindle being notched out at its outer end, the notch comprising a longitudinal slot and an adjoining partial circumferential space, the outer spindle having thereinside a central boss having a radial finger and second spring means in the outer spindle urging the boss inward toward the latch housing, the outer handle having a shank with a longitudinal interior keyway, the boss and finger normally disposed by the second spring means with the finger extending through the longitudinal slot and into the keyway to key the outer handle and the outer tubular spindle into unitary rotation with each other, and drive means associated with one of the handles to move the boss to move the radial finger into the circumferential space so that the outer handle is disconnected from the outer spindle, and third spring means disposed in the rose of the outer handle for biasing the outer handle toward its horizontal "home" position.

6. A door lock as claimed in claim 5 wherein the outer handle has a central lock cylinder having an operator tail adapted when turned to cause the drive means to retreat.

7. A door lock as claimed in claim 5 further including a cam means and a release tube, and wherein the drive means comprises the cam means receiving the tailpiece which, when rotated, drives the cam means disposed inside the outer tubular spindle to move the release tube also disposed inside the spindle which drives the boss and moves the finger into the circumferential space.

8. A door lock as claimed in claim 7 wherein the outer tubular spindle includes a transverse pin and the cam means is a tubular element telescoped inside the release tube and has a cam surface on one end engaging the transverse pin and the turning of the tailpiece rotates the cam means to move the release tube in a direction toward the cylinder.

9. A door lock as claimed in claim 8 wherein the release tube is formed with an outwardly directed projection and when the finger is in the circumferential space the projection is immobilized in fixed structure which mounts the lock and thereby blocks rotations of the outer spindle.

10. A door lock comprising an outside lever handle having a rose, a latch operator connected to the lever handle, means for disconnecting the lever handle from the latch operator and spring means within the rose for biasing the lever handle in a horizontal disposition whether or not the lever handle is connected to the latch operator.

11. A door lock comprising an outside lever handle having a rose, an inside handle and a latch operator connected to the outside lever handle and the inside handle, means for disconnecting the lever handle from the latch operator and for disabling the latch operator, stop means for limiting the free-wheeling of the lever handle when it is disconnected from the latch operator and biasing means in the rose for biasing the lever in a horizontal disposition whether or not the lever handle is connected to the latch operator.

12. A door lock as claimed in claim 11 wherein the stop means for limiting the free-wheeling of the lever handle and the spring means biasing the lever handle in a horizontal disposition comprises a plate keyed to the lever handle and perpendicular to the axis of rotation of the handle, structure stationary in the rose, the plate being formed with a shoulder adapted to contact the stationary structure upon partial rotation of the lever handle, the plate also carrying a spring adapted to work against the stationary structure to comprise the biasing means.

13. A door lock as claimed in claim 11 wherein the means for disconnecting the lever handle from the latch operator and for disabling the latch operator comprises shiftable means axially shiftable of the lock and including radial pawl means adapted to link together the lever handle and the latch operator in one axial position and to not link them in another axial position and also including dogging means to immobilize the latch operator.

14. A door lock as claimed in claim 11 wherein the latch operator has an outer spindle and the outside lever handle is longitudinally fixed and rotatably mounted with respect to the rose and both the stop means and the biasing means are in the rose, and the means for disconnecting the lever handle from the latch operator comprises a longitudinally movable radial pawl disposed in the outer spindle of the latch operator and which rides in a keyway in the handle, whereby the handle and rose may be telescopingly located along the spindle at a position depending on the thickness of the door.

* * * * *

US004920773B1

REEXAMINATION CERTIFICATE (3103rd)

United States Patent [19] [11] B1 4,920,773

Surko, Jr. [45] Certificate Issued Jan. 14, 1997

[54] DOOR LOCK HAVING DISENGAGED OUTER LEVER HANDLE WHEN IN THE LOCKED CONDITION AND MEANS TO BIAS THE HANDLE TOWARD HORIZONTAL POSITION

[75] Inventor: Walter E. Surko, Jr., Southington, Conn.

[73] Assignee: Yale Security Inc., Monroe, N.C.

Reexamination Request:
No. 90/003,688, Jan. 17, 1995

Reexamination Certificate for:

| | |
|---|---|
| Patent No.: | **4,920,773** |
| Issued: | **May 1, 1990** |
| Appl. No.: | **153,215** |
| Filed: | **Feb. 8, 1988** |

[51] Int. Cl.[6] ..... E05B 13/10

[52] U.S. Cl. ..... 70/224; 70/472; 70/149; 292/352

[58] Field of Search ..... 70/209, 218, 222–224, 70/149, 472, 489; 292/352, 359, 336.3, 347, 348

[56] References Cited

U.S. PATENT DOCUMENTS

| | | | |
|---|---|---|---|
| 1,871,442 | 8/1932 | Benzec | 70/218 |
| 1,960,410 | 5/1934 | Christensen | 70/91 |
| 4,236,396 | 12/1980 | Surko, Jr. et al. | 70/107 |
| 4,594,864 | 6/1986 | Hart | 70/143 |

FOREIGN PATENT DOCUMENTS

| | | | |
|---|---|---|---|
| 2140070 | 11/1984 | United Kingdom | E05B 3/00 |

*Primary Examiner*—Suzanne L. Dino

[57] ABSTRACT

A drive element in this lock pushes a radially directed outward finger out of its longitudinal slot in the outer tubular spindle to disengage the outer handle from the latch so that the handle free-wheels. Spring means in the outer handle rose returns the handle to its normal horizontal position when the handle is released. The handle is preferably in lever form.

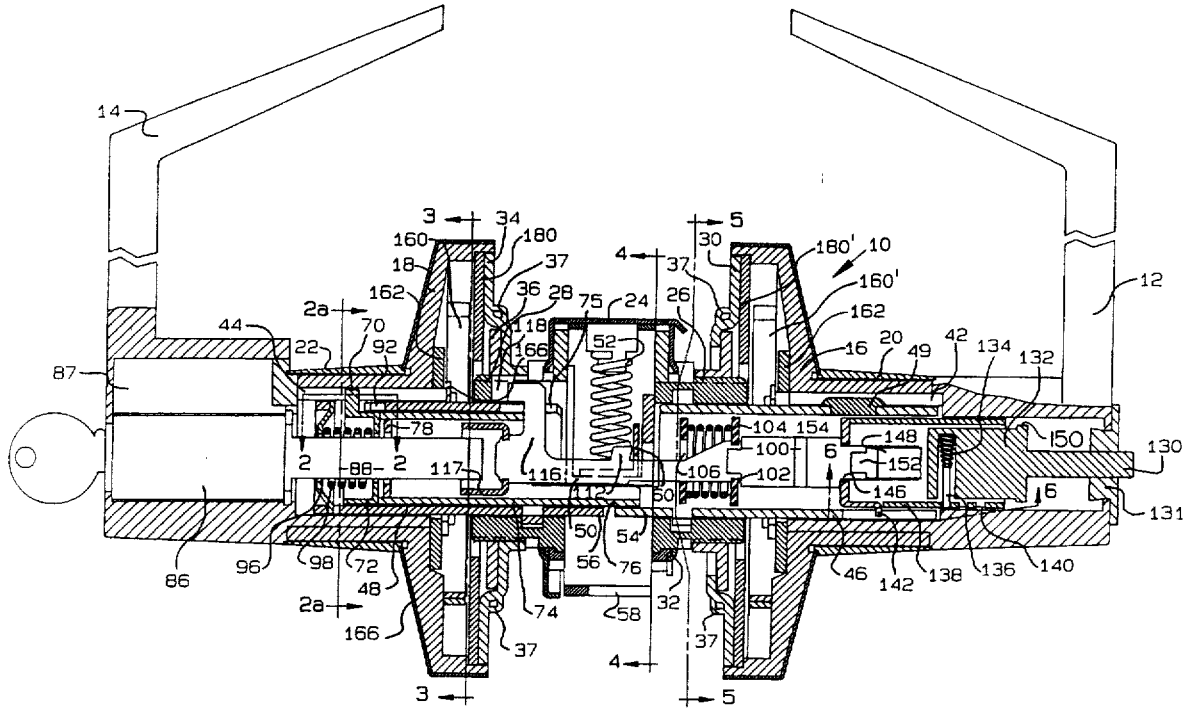

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 48–55:

The shanks of the respective handles 12 and 14 are provided with interior keyways 42 and 44 respectively, and the inner shank telescopes over the inner tubular spindle 46 journaled to rotate in the boss 26, while the outer handle contains the outer tubular spindle 48 which rotates in boss 28. Key 49 mounted in an opening in the *inner* tubular spindle 46 extends into keyway 42 to link the two parts for rotation together.

Column 2, line 56 to Column 3, line 2:

Latch housing 24 is provided with a customary retractor 50, which is spring-pressed downward (FIG. 1) by a pair of side-by-side springs 52 mounted in conventional fashion and held in compression between their mountings at the top of housing 24 and the retractor 50. As shown best in FIG. 1, the two tubular spindles are formed with arcuate pull-back ends *or scoops* 54 and 56 so that when either of the spindles is rotated by its respective handle, the end of the pull-back forces the retractor 50 upward, as viewed in FIG. 4, to draw the latch actuator 58 inward, disengaging the latch, not shown. The retractor 50 is also provided with a catch retainer 60, having a flange under the springs 52 and which raises with the retractor 50 for purposes to be described.

Column 3, lines 3–11:

Disposed in the keyway 44 (FIG. 2a) of the outer handle is the distal end of a radial finger 70. The finger 70 is formed at the outer end of a cup-shaped element 72, which rides inside the leftward end (FIG. 1) of the outer tubular spindle 48. The rightward end of the cup-shaped element 72 butts against [the end depressor] *a release tube* 74, which is disposed inside the outer tubular spindle [56] *48*. At its rightward end the outer tubular spindle [56] *48* is formed with a longitudinal dogging slot 75.

Column 3, lines 12–16:

At its rightward end the [depressor] *release tube* 74 is formed with an arcuate latch-retractor-raising scoop 76 disposed under the retractor 50, and in its leftward end the [depressor] *release tube* 74 mounts a fixed closure plate 78 with an irregular opening 80 therein (FIG. 3).

Column 3, lines 17–23:

Central of the outer handle 14 a key cylinder 86 having a bible 87 is provided. The bible 87 is keyed into an opening in the shank of handle 14. The cylinder has a flat operating tail 88. The tail extends through a circular opening in the rightward end of the cup-shaped element 72 and into the odd-shaped opening 80 of the [end] *fixed closure* plate 78 (FIG. 3).

Column 3, lines 24–32:

The outer tubular spindle is slotted, as best shown in FIG. 2, at 90. The slot includes a relatively narrow longitudinal portion 92 adapted to receive the finger 70, and a circumferential slot or space 94 which extends laterally with respect to the longitudinal portion 92. A dish-shaped retainer 96 having a circular cutout therein which passes the tail 88 is disposed in the circumferential [portion 90] *space 94* of the slot and butts against the leftward margins of the slot *90*.

Column 3, lines 33–44:

A spiral spring 98 loosely surrounds the tail 88 and is disposed between the rightward wall of the cup-shaped element 72 and the dish-shaped retainer 96 to urge the cup-shaped element 72 and finger 70 rightward so that in operative condition of the handle 14, the finger 70 is disposed in slot 92 and extends outward to keyway 44 to key together the outer tubular spindle 48 and the shank of the outer handle 14. On the other hand, when the finger 70 is in the position shown, rotation of the handle 14 will merely turn the finger 70, but not the tubular spindle, because the inward portion of the finger 70 is free to move in the space [90] *94* when the handle is turned.

Column 3, lines 45–52:

Disposed inside the inner tubular spindle 46 and the outer tubular spindle 48 and *the* release tube 74 is a pushpiece 100. This piece is biased to the right, as shown in FIG. 1, by a spring 102, which is sandwiched between a washer 104 disposed in notches in the pushpiece, and the apertured disc 106, which has ears (FIG. 5) 108 which fixedly mount it in appropriate openings 110 in the inner tubular spindle 46.

Column 3, lines 53–66:

The pushpiece is provided with a catch 112, which has an inclined left edge and snaps past catch retainer 60, free to raise against the springs 52 when the piece 100 is pushed leftward. Once it is in the position shown in FIG. 1, it is held in that leftward position and the dog 116, which is offset, extends into the dog slot 75 in the outer tubular spindle 48 and into a slot 118 in the threaded boss 28. This locks the outer tubular spindle from rotation. At the same time, the dog 116 pushes the release [element] *tube* 74 to the left to move the finger 70 out of the longitudinal portion 92 of the slot in the tubular spindle *48* and into the space [90] *94* to permit the outer handle 14 to free-wheel. On its leftward end (FIG. 1) the pushpiece is provided with [the] *a* stabilizing cup 117.

Column 4, lines 11–24:

An outwardly struck tongue 142 is provided in the housing and slides in a roughly L-shaped opening 144 (FIG. 6) in the [outer] *inner* tubular spindle 46. The leftward end of the [manipulator] *tubular* housing 138 is formed with a circular aperture 146. This aperture 146 receives the end of a reduced tongue 148 of the pushpiece 100 and makes possible the rotation of the housing 138 without the rotation of the pushpiece 100. Shoulders 150 on the pushpiece assure that the leftward movement of the [manipulator] *thumbpiece* 130 (FIG. 1) will result in the leftward movement of the entire pushpiece 100, release tube 74, cup-shaped element 72 and, finally, finger 70. A speed clip [52 *152* on the end of the reduced tongue 148 holds the housing on the tongue.

Column 4, lines 25–38:

As shown best in FIG. 3, means for returning the handle 14 to horizontal position after release are disposed in the rose 18 and comprise a horseshoe-shaped pair of springs 160. These springs are positioned against a stop plate 162, which is keyed to the shank of outer handle 14 by a projection 164 (FIG. 3) and held against the inside of the rose by a spring retainer 166, which snaps into a groove 168 in the end of the shank of handle [114] *14*. Stop plate 162 therefore turns with the shank. Disposed on the stop plate 162 is a pair of spaced lugs 170, which extend perpendicular to the stop plate in a direction toward the latch housing 24. These lugs 170 embrace the two radially deflected ends 172 of the spring 160.

Column 4, lines 39–46:

As shown in FIG. 3 and described, the rose is formed with a plurality of spaced cylindrical bosses 31, which are internally threaded and aligned with openings 40 in plate 30. Two of the bosses 31 are radially aligned with the lugs 170 when the handle 14 is in normal position. As shown, the [radial] *radially deflected* ends 172 of the spring 160 extend outward to also be engaged or embraced by the outward surfaces of the ends by the adjacent bosses 31.

Column 4, lines 58–62:

Spring 160 in the rose 18 and its related shape, stop plate 162 and its retaining means, and bosses [174] *31* are all duplicated inside the rose 16 wherein the spring is designated 160'. The springs 160 and 160' are provided with apertured cover plates 180 and 180'.

Column 4, lines 63–65:

Anchor pins (not shown) extend inwardly from the mounting plates 34, [36] *30* to hold the latch housing 24 from rotating.

Column 5, lines 2–17:

In operation, the lock of the invention is invariably locked from the inside by pushing the [manipulator 30] *thumbpiece 130* in so that the push-piece 100 moves leftwardly until the catch 112 snaps past and behind the catch retainer 60. In this position, as shown in FIG. 1, the dog 116 fits into the [locking] *dogging* slot [76] *75* of the outer tubular spindle 48 and into the slot 118 in the threaded boss 28. This locks the outer tubular spindle from rotation. At the same time, the dog 116 presses the release tube 74 leftwardly to move the finger 70 out of its slot 92 (FIG. 2) in the tubular spindle 48. This permits the free-wheeling of the outer handle 14 whereby the handle may be rotated 60 degrees against the force of the spring 160 until the [projection] *shoulder* 200 on stop plate 162 contacts [lug] *projection* 201. Upon being released, the handle 14 will be returned to its normal horizontal position by the spring 160.

Column 5, lines 18–34:

In the semi-locked condition described above, the door may be unlocked from the outside by a key in the cylinder 86. Rotation of the cylinder barrel causes rotation of the [tongue] *tail* 88 in the odd-shaped opening of the plate 78 (FIG. 3). Plate 78, being staked to the [depressor] *release* tube 74, causes rotation of the scoop 76 (FIG. 5) to raise the retractor along with the catch retainer 60. Raising of the retractor causes the latch actuator 58 to move inwardly, unlatching the door. At the same time, because the catch retainer 60 is raised, the catch 112 escapes to the right, permitting the dog 116 to move to the right also. The rightward movement of the dog 116 also permits the rightward movement of the release tube 74, which permits the finger 70 to move rightwardly into its longitudinal slot 92. From this moment the door is thereafter unlocked from the outside and *the* handle [24] *14* is operated to unlatch the door.

Column 5, lines 35–37:

All during this time the inner handle 12, keyed to the inner tubular spindle 46 as at 42, [43] *49*, is operable to raise the retractor 50 by means of the arcuate pull-back 54.

Column 5, lines 38–43:

For more permanent locking of the door the [manipulator] *thumbpiece* 130 may be pressed in and turned so that the tongue 142 (FIG. 6) rides into the circumferential [slot] *portion of L-shaped opening* 144 [of its opening]. This holds the [manipulator] *thumbpiece* 130 inward, pressing the pushpiece 100 to the left against spring 102.

Column 5, lines 44–51:

While actually in this process the catch 112 snaps past catch retainer 60, this is not important because tongue 142 holds the pushpiece 100 leftwardly even after the raising of the retractor 50. The pushpiece 100 will subsequently be permitted to move to the right only after the [manipulator] *thumbpiece* 130 has been turned so that tongue 142 is free to move longitudinally in the longitudinal portion of [slot] *opening* 144.

Column 5, lines 52–55:

During the permanent locking described above wherein the [manipulator] *thumbpiece* 130 is pushed in and turned, the locking operation with respect to dog 116 and finger 70 is the same as in the semi-lock column.

Column 5, lines 61–64:

When the lock is unlocked, handles 12 and 14, working respectively through the tubular spindles 46 and 48 and their arcuate *pull-back* ends 54 and 56, can raise the retractor 50 against the springs 52 to unlatch the door.

Column 6, lines 24–38:

The outer tubular spindle 48' is provided inside with the cup element 72' having the finger 70' extending out the opening [92] *92'*, as shown. The finger 70' is adapted to key into the keyway 44, as in the earlier embodiment. A spring 98' is held in compression between the cup-shaped element 72' and the retaining disc 96'. A release tube 74' is disposed inside the spindle 48' and is slotted as at *elongated opening* 302 to receive a pin 304 fixedly disposed across the release tube. The release tube is formed with an upwardly struck ear 306 which moves in the slot 75' in the spindle. Note that when the outer handle is unlocked (FIG. 7), the end of ear 306 is in the annular groove 308 in the boss 28', and when the outer handle is locked, the ear 306 is disposed in the slot 75' and also in a slot 118' in the boss 28', immobilizing the spindle.

Column 6, lines 39–43:

As in the earlier embodiment, when the outer handle is locked, the finger 70' is moved leftwardly (FIG. 7) out into the circumferential part of [opening] *slot* 90' so that the turning of the handle (not shown) turns the finger 70' and the cup 72' but does not turn the spindle 48'.

Column 6, lines 56–61:

Means for driving the cam tube 310 is the cam tube drive 320, which is a tubular element 322 (FIG. 11) having diametrically opposed outward longitudinal ridges *or projections* 324. Aligned with the ridges and directed towards the axis of the tubular element 322, are inward points 326.

Column 7, lines 3–19:

The final element of the assembly is a cap 328 (FIGS. 7 and 8) which has ears (not shown) fitting into slots (not shown) in the left end of the release tube 74'. The end of the release tube to the left (FIGS. 7 and 8) of the cap 328 is staked over to hold the cap in firm non-rotary position with respect to the tube 74'. The spindle assembly, comprising the spindle 48', the release tube 74', the spring 98', the retainer 96', the cap [4328] *328*, the cam tube 310 and the cam tube *drive* 320, is assembled separately by loading the cam tube 310, drive 320 and cap 328 into the release tube 74', staking the cap 328 as described, and inserting the pin 304 into the spindle through the elongated opening 302 in the release tube. The release tube assembly is then inserted into the spindle from the right. Thereafter the cup 72' is inserted, as shown in FIG. 7, through the opening 90'. The spring 98' and retainer 96' are then put into place.

Column 7, lines 20–29:

In the final assembly the subassemblies of FIGS. 7 and 8 are equipped, as shown in FIG. 1, with the roses, and the handle 14, including the cylinder 86 with its tail 88, is assembled over the outer spindle 48', the tail 88 extending into the drive 320. The key may then be inserted into the cylinder 86, and turned. For locking the assembly the key may be turned counterclockwise. After some rotary lost motion, the tail 88', as shown in dotted lines in FIG. 9, engages the points 326 of the drive and rotates it [clockwise] *counterclockwise* also.

Column 7, lines 30–41:

Eventually, after some additional lost motion, the ridges 324 on the drive engage the legs 318 on the cam tube, rotating the latter and causing the cam surface 314 to bear against the stationary pin 304, driving the release tube assembly leftwardly till pin 304 nestles into [land] *landing surface* 316. This moves the cup 72' also leftwardly so that the finger 70' clears the [radial] *longitudinal* notch of [opening 92'] *slot 90'* and unkeys the finger from the rotary movement of the tubular spindle 48'. At the same time, the [tongue] *ear* 306 moves leftwardly from a nonblocking position aligned with annular groove 308 into the slot [318'] *118'* in the boss 28', blocking the rotation of the spindle 48'.

Column 7, lines 48–63:

Unlocking the door is much the same in reverse. The key is turn clockwise, which causes the tail 88 (FIG. 9) to eventually engage the points 326 and rotate them clockwise as well. This, of course, turns the drive 320 through considerable lost motion to eventually cause the ridges 324 to engage the legs 318 of the cam tube 310. Clockwise rotation of the cam tube moves the [land] *landing surface* 316 off the pin 304, and permits the tube to slide rightwardly as the stationary pin 304 moves down slope 314. This permits the release tube, as well as the driver, to move rightwardly by the spring 98'. Eventually two things happen. The [tongue] *ear* 306 moves into the clearance groove 308, freeing the tubular spindle 48' for rotation and the finger 70' moves into the notch part 92' of the [opening] *slot*. The finger 70' now keys the handle for rotation with the tubular spindle 48'.

Figure 12:
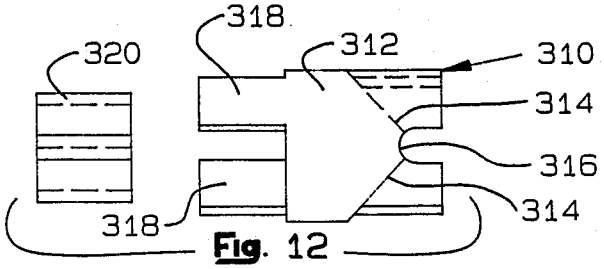
FIG. 12 is a side exploded view of the cam tube and cam tube driver.

THE DRAWING FIGURES HAVE BEEN CHANGED AS FOLLOWS:

FIG. 1—ref numeral 150 moved; lead line for 146 added and 162 extended; 180 and 160 changed to 180' and 160'. FIG. 3—ref. num. 80 added. FIG. 7—90' added; 318' changed to 118'; 310' changed to 310; 328' changed to 328; lead line for 304 added; 306' changed to 306. FIG. 8—90' added; 318' changed to 118'; 306', 308', 314', 310', 328' changed to 306, 308, 314, 310, 328; lead line for 316 added. FIG. 12—314 changed to 314a.

AS A RESULT OF REEXAMINATION, IT HAS BEEN DETERMINED THAT:

Claim 10 is cancelled.

Claims 1, 3–5, 7, 8 and 11–13 are determined to be patentable as amended.

Claims 2, 6, 9, 14, dependent on an amended claim, are determined to be patentable.

New claims 15–58 are added and determined to be patentable.

1. A dock lock comprising:

an inner handle, an outer handle in the form of a lever normally disposed horizontally and having a rose, a latch housing between the handles [and], *the latch housing* containing a latch retractor,

[and] first spring means biasing the *latch* retractor outwardly toward latched disposition, an inner *tubular spindle* and an outer tubular spindle receiving the respective handles and both terminating respectively inside the lock in arcuate pull-back scoops, the two scoops being aligned end-to-end and disposed against the side of the *latch* retractor opposite the first spring means and each being adapted when turned to move the *latch* retractor inwardly, the inside handle being keyed to the inner spindle, the outer spindle being notched out at its outer end, the notch comprising a longitudinal slot and an adjoining partial circumferential space, the outer spindle having thereinside a central boss having a radial finger and second spring means urging the boss inward toward the latch housing, the outside handle having a shank with a longitudinal interior keyway, the boss and finger normally disposed by the second spring means with the finger extending through the longitudinal slot and into the keyway to key the outer handle and the outer tubular spindle into unitary rotation with each other, and push-piece means terminating in an actuator central of the inner [knob] *handle* and extending through the outer and inner tubular spindles and adapted on depressing to engage and push the boss to move the radial finger into the circumferential space so that the outer handle is free to turn unkeyed from the outer spindle, releasable catch means for holding the push-piece means in the depressed condition, and third spring means disposed in the rose of the outer handle for biasing the outer handle toward its normal position.

3. A door lock as claimed in claim 1 wherein the third spring means is a horseshoe-shaped spring having radially deflected ends and circomposing the outer tubular spindle and the outer handle carries a radial bracket in the rose having spaced lugs embracing the radially deflected ends of the third spring means, and projections means on the rose generally radially aligned respectively with the lugs when the lever *handle* is in said normal position, the projection means also embracing the radially deflected ends and whereby when the handle is turned, the bracket rotates and flexes one end of the spring toward the other end so that when the handle is released, the third spring means returns the outer handle to normal position.

4. A door lock as claimed in claim 1 wherein a hub surrounds [a] *the outer* tubular spindle of the outer handle and both [said last-mentioned] *the outer tubular* spindle and the hub are formed with longitudinal slots and the pushpiece means includes a radially disposed dog which when the pushpiece means is depressed is disposed in both of said [last-mentioned] slots to lock the outer tubular spindle from rotation.

5. A door lock comprising:

an inner handle, an outer lever handle having a rose and having a horizontal "home" position, a latch housing between the handles [and], *the latch housing* containing a latch retractor,

[and] first spring means biasing the *latch* retractor outwardly toward latched disposition, an inner and an outer tubular spindle receiving the respective handles and both terminating respectively inside the lock in arcuate pull-back scoops, the two scoops being aligned end-to-end and disposed against the side of the *latch* retractor opposite the first spring means and each being adapted when turned to activate the latch retractor, the inner handle being keyed to the inner spindle, the outer spindle being notch at its outer end, the notch comprising a longitudinal slot and an adjoining partial circumferential space, the outer spindle having thereinside a central boss having a radial finger,

[and] second spring means in the outer spindle urging the boss inward toward the latch housing, the outer handle having a shank with a longitudinal interior keyway, the boss and finger normally disposed by the second spring means with the finger extending through the longitudinal slot and into the keyway to key the outer handle and the outer tubular spindle into unitary rotation with each other,

[and] drive means associated with one of the handles to move the boss to move the radial finger into the circumferential space so that the outer handle is disconnected from the outer spindle, and third spring means disposed in the rose of the outer handle for biasing the outer handle toward its horizonal "home" position.

7. A door lock as claimed in claim [5] *6* further including a cam means and a release tube, *the cam means and release tube disposed inside the outer tubular spindle,* and wherein the drive means comprises the cam means receiving the [tailpiece] *operator tail* which, when rotated, drives the cam means [disposed inside the outer tubular spindle]to move the release tube [also disposed inside the spindle] which drives the boss and moves the finger into the circumferential space.

8. A door lock as claimed in claim 7 wherein the outer tubular spindle includes a transverse pin and the cam means is a tubular element telescoped inside the release tube [and has], *the cam means having* a cam surface on one end engaging the transverse pin and the turning of the [tailpiece] *operator tail* rotates the cam means to move the release tube in a direction toward the cylinder.

11. A door lock comprising an outside lever handle having a rose, an inside handle [and], a latch operator connected to the outside lever handle and the inside handle, means for disconnecting the lever handle from the latch operator and for [disabling] *blocking the operation of* the latch operator, stop means for limiting the free-wheeling of the lever handle when it is disconnected from the latch operator, and biasing means in the rose for biasing the lever *handle* in a horizontal disposition whether or not the lever handle is connected to the latch operator.

12. A door lock as claimed in claim 11 wherein the stop means for limiting the free-wheeling of the lever handle and the [spring] means biasing the lever handle in a horizontal disposition comprises a plate keyed to the lever handle and perpendicular to the axis of rotation of the handle, structure stationary in the rose, the plate being formed with a shoulder adapted to contact the stationary structure upon partial rotation of the lever handle, the plate also carrying a spring adapted to work against the stationary structure to comprise the biasing means.

13. A door lock as claimed in claim 11 wherein the means for disconnecting the lever handle from the latch operator and for [disabling] *blocking the operation of* the latch operator comprises shiftable means axially shiftable of the lock and including radial pawl means adapted to link together the lever handle and the latch operator in one axial position and to not link them in another axial position and also including dogging means to immobilize the latch operator.

*15. A door lock as recited in claim 13, further comprising means associated with the inner handle for moving the radial pawl means from the first axial position to the second axial position.*

*16. A door lock as recited in claim 15, wherein the radial pawl moving means comprises a pushpiece terminating in an actuator associated with the inside handle, the pushpiece engaging the axially shiftable means upon depression of the actuator for moving the radial pawl means to the second axial position.*

*17. The door lock as recited in 16, wherein the latch operator comprises an outer tubular spindle and further comprising a hub surrounding the outer tubular spindle, the outer tubular spindle and hub each having a slot and the dogging means comprises a radial dog on the pushpiece disposed in both slots when the pushpiece has moved the radial pawl means to the second axial position for locking the outer tubular spindle from rotation.*

*18. The door lock as recited in claim 16, further comprising a releasable catch for holding the pushpiece in depressed condition.*

*19. The door lock as recited in claim 18, wherein the outside lever handle further comprises a central lock cylinder having an operator tail adapted when turned for releasing the catch.*

*20. A door lock as recited in claim 13, further comprising means associated with the outside lever handle for moving the radial pawl means from the first axial position to the second axial position.*

*21. A door lock as recited in claim 20, wherein the radial pawl means moving means comprises a central lock cylinder having an operator tail adapted when turned for moving the radial pawl means from the first axial position to the second axial position.*

*22. A door lock as recited in claim 21, wherein the latch operator comprises an outer tubular spindle and wherein the radial pawl means moving means further comprises a cam element and a release tube, the cam element and release tube disposed inside the outer tubular spindle, the cam element receiving the operator tail which, when rotated, drives the cam element to move the release tube for moving the radial pawl means to the second axial position.*

*23. A door lock as recited in claim 22, wherein the outer tubular spindle includes a transverse pin and the cam element comprises a tubular element telescopically disposed in the release tube, the tubular element having a cam surface on one end engaging the transverse pin for moving the release tube when the operator tail is rotated.*

*24. A door lock as recited in claim 22, wherein the release tube further comprises an outwardly directed radial ear, the ear immobilized in fixed structure which mounts the lock blocking rotation of the outer tubular spindle when the radial pawl means is in the second axial position.*

*25. A door lock, comprising:*

*an outside lever handle disposed in a horizontal disposition, the lever handle having a rose,*

*a latch operator connected to the lever handle,*

*an inner handle,*

*means for disconnecting the lever handle from the latch operator, the disconnecting means comprising*

*an axially shiftable means for linking the outside lever handle and the latch operator, the linking means linking together the lever handle and the latch operator in a first axial position and leaving the lever handle and the latch operator unlinked in a second axial position,*

*a pushpiece terminating in an actuator associated with the inner handle, the pushpiece engaging the linking means upon depression of the actuator for moving the linking means to the second axial position, and*

*a releasable catch for holding the pushpiece in depressed condition, and*

*spring means disposed inside the rose for returning the lever handle to the horizontal disposition whether or not the lever handle is connected to the latch operator.*

*26. A door lock as recited in claim 25, wherein the latch operator of the outside lever handle comprises an outer tubular spindle, the door lock further comprising a hub surrounding the outer tubular spindle, the outer tubular spindle and hub each having a slot and the pushpiece having a radial dog disposed in both slots when the pushpiece has moved the linking means to the second axial position for locking the outer tubular spindle from rotation.*

*27. The door lock as recited in claim 25, wherein the outside lever handle further comprises a central lock cylinder having an operator tail adapted when turned for releasing the catch.*

*28. A door lock as recited in claim 25, further comprising means for limiting the rotation of the outside lever handle.*

*29. A door lock as recited in claim 28, wherein the rotation-limiting means comprises structure sstationary in the rose, the outside lever handle adapted to contact the stationary structure upon partial rotation of the outside lever handle.*

*30. A door lock as recited in claim 25, wherein the latch operator comprises an outer tubular spindle and the outside lever handle is longitudinally fixed and rotatably mounted with respect to the rose, and the linking means comprises a projection disposed in the outer tubular spindle of the latch operator, the projection riding in a longitudinal keyway in the handle, the handle and rose telescopically locatable along the spindle at a position depending on the thickness of the door.*

*31. A door lock as claimed in claim 25, wherein the spring means comprises*

*a horseshoe-shaped spring having radially deflected ends, the spring circumposing the outer tubular spindle, and further comprising*

*a radial bracket carried on the handle in the rose, the radial bracket having spaced lugs embracing the radially deflected ends of the spring, and*

*projections means on the rose generally radially aligned respectively with the lugs when the lever handle is in said horizontal disposition, the projection means also embracing the radially deflected ends,*

*the bracket rotating when the handle is turned flexing one end of the spring toward the other end so that when the handle is released the spring returns the outer handle to the horizontal disposition.*

*32. A door lock as recited in claim 29, further comprising a plate keyed to the handle, the plate having a shoulder adapted to contact the stationary structure upon partial rotation of the handle.*

*33. A door lock, comprising:*

*an outside lever handle disposed in a horizontal disposition, the lever handle having a rose,*

*a latch operator connected to the lever handle,*

*means for disconnecting the lever handle form the latch operator, the disconnecting means comprising*

*an axially shiftable means for linking the outside lever handle and the latch operator, the linking means linking together the lever handle and the latch operator in a first axial position and leaving the lever handle and the latch operator unlinked in a second axial position, and*

*a lock cylinder associated with the outside lever handle, the lock cylinder having an operator tail adapted when turned for moving the linking means from the first axial position to the second axial position, and*

*spring means disposed inside the rose for returning the lever handle to the horizontal disposition whether or not the lever handle is connected to the latch operator.*

*34. A door lock as recited in claim 33, wherein the latch operator comprises an outer tubular spindle and further comprising a cam element and a release tube, the cam element and release tube disposed inside the outer tubular spindle, the cam element receiving the operator tail which, when rotated, drives the cam element to move the release tube for moving the linking means.*

*35. A door lock as recited in claim 34, wherein the outer tubular spindle includes a transverse pin and the cam element comprises a tubular element telescopically disposed in the release tube, the tubular element having a cam surface on one end engaging the transverse pin for moving the release tube when the operator tail is rotated.*

*36. A door lock as recited in claim 34, wherein the release tube further comprises an outwardly directed radial ear, the ear immobilized in fixed structure which mounts the lock blocking rotation of the outer tubular spindle when the linking means is in the second axial position.*

*37. A door lock as recited in claim 33, further comprising means for limiting the rotation of the outside lever handle.*

*38. A door lock as recited in claim 37, wherein the rotation-limiting means comprises structure stationary in the rose, the outside lever handle adapted to contact the stationary structures upon partial rotation of the outside lever handle.*

*39. A door lock as recited in claim 33, wherein the latch operator comprises an outer tubular spindle and the outside lever handle is longitudinally fixed and rotatably mounted with respect to the rose, and the linking means comprises a projection disposed in the outer tubular spindle of the latch operator, the projection riding in a longitudinal keyway in the handle, the handle and rose telescopically locatable along the spindle at a position depending on the thickness of the door.*

*40. A door lock as claimed in claim 33, wherein the spring means comprises*

*a horseshoe-shaped spring having radially deflected ends, the spring circumposing the outer tubular spindle, and further comprising*

*a radial bracket carried on the handle in the rose, the radial bracket having spaced lugs embracing the radially deflected ends of the springs, and*

*projections means on the rose generally radially aligned respectively with the lugs when the lever handle is in said horizontal disposition, the projection means also embracing the radially deflected ends,*

*the bracket rotting when the handle is turned flexing one end of the spring toward the other end so that when the handle is released the spring returns the outer handle to the horizontal disposition.*

*41. A door lock as recited in claim 38, further comprising a plate keyed to the handle, the plate having a shoulder adapted to contact the stationary structure upon partial rotation of the handle.*

*42. A door lock, comprising:*

*an outside lever handle disposed in a horizontal disposition, the outside lever handle having a rose and a shank with a longitudinal keyway;*

*a latch operator, the latch operator comprising:*

*a tubular spindle receiving the handle shank, the tubular spindle having a notch, the notch including a longitudinal slot and an adjoining circumferential space, and*

*a boss movably disposed in the tubular spindle, the boss having a radial finger extending through the notch for linking the tubular spindle to the keyway of the handle shank for unitary rotation of the handle and the latch operator when the radial finger is in the longitudinal slot;*

*a lock cylinder associated with the outside lever handle, the lock cylinder having an operator tail adapted when turned for moving the boss and radial finger from the longitudinal slot to the circumferential space for disconnecting the handle from the latch operator freeing the handle to turn unkeyed to the latch operator; and*

*spring means disposed inside the rose for returning the lever handle to the horizontal position whether the boss is in the longitudinal slot or the circumferential space and wherein the longitudinal slot and the radial finger are aligned.*

*43. A door lock as recited in claim 42, further comprising a cam element and a release tube, the cam element and release tube disposed in the outer tubular spindle, the cam element receiving the operator tail which, when rotated, drives the cam element to move the release tube for moving the boss.*

*44. A door lock as recited in claim 43, wherein the outer tubular spindle includes a transverse pin and the cam element comprises a tubular element telescopically disposed in the release tube, the tubular element having a cam surface on one end engaging the transverse pin for moving cam element to move the release tube and the boss when the operator tail is rotated.*

*45. A door lock as recited in claim 43, wherein the release tube further comprises an outwardly directed radial ear, the ear immobilized in fixed structure which mounts the lock for blocking rotation of the outer tubular spindle when the radial finger is in the circumferential space.*

*46. A door lock as recited in claim 42, further comprising means for limiting the turning range of the handle.*

*47. A door lock as recited in claim 46, wherein the turning range limiting means comprises structure stationary in the rose, the handle adapted to contact the structure upon partial rotation of the handle.*

*48. A door lock as recited in claim 47, further comprising a plate keyed to the handle, the plate having a shoulder adapted to contact the stationary structure upon partial rotation of the handle.*

*49. A door lock as recited in claim 42, wherein the outside lever handle is longitudinally fixed and rotatably mounted with respect to the rose, the lever handle and rose telescopically locatable along the spindle at a position depending on the thickness of the door.*

*50. A door lock as claimed in claim 42, wherein the spring means comprises*

*a horseshoe-shaped spring having radially deflected ends, the spring circumposing the tubular spindle,*

*and futher comprising*

*a radial bracket carried on the handle in the rose, the radial bracket having spaced lugs embracing the radially deflected ends of the spring, and*

*projections means on the rose generally radially aligned respectively with the lugs when the lever handle is in said horizontal disposition, the projection means also embracing the radially deflected ends,*

*the bracket rotating when the handle is turned flexing one end of the spring toward the other end so that when the handle is released the spring returns the handle to a position wherein the longitudinal slot and the radial finger are aligned.*

*51. A door lock, comprising:*

*an outside lever handle disposed in a horizontal disposition, the outside lever handle having a rose and a shank with a longitudinally keyway;*

*a latch operator, the latch operator comprising:*

*a tubular spindle receiving the handle shank, the tubular spindle having a notch, the notch including a longitudinal slot and an adjoining circumferential space, and*

*a boss movably disposed in the tubular spindle, the boss having a radial finger extending through the notch for linking the tubular spindle to the keyway of the handle shank for unitary rotation of the handle and the latch operator when the radial finger is in the longitudinal slot;*

*an inner handle,*

*a pushpiece terminating in an actuator associated with the inner handle, the push-piece engaging the boss upon depression of the actuator for moving the boss and the radial finger from the longitudinal slot to the circumferential space for disconnecting the handle from the latch operator freeing the handle to turn unkeyed to the latch operator;*

*a releasable catch for holding the pushpiece in depressed condition; and*

*spring means disposed inside the rose for returning the lever handle to the horizontal position whether the boss is in the longitudinal slot or the circumferential space and wherein the longitudinal slot and the radial finger are aligned.*

*52. The door lock as recited in claim 51, wherein the outside lever handle further comprises a central lock cylinder having an operator tail adapted when turned for releasing the catch.*

*53. A door lock as recited in claim 51, further comprising a stationary hub surrounding the tubular spindle, the hub and tubular spindle each having a slot, and the pushpiece having a radially disposed dog which when the pushpiece is depressed is disposed in the both the hub slot and the tubular spindle slot for preventing the latch operator from rotating.*

*54. A door lock as recited in claim 51, further comprising means for limiting the turning range of the handle.*

*55. A door lock as recited in claim 54, wherein the turning range limiting means comprises structure stationary in the rose, the handle adapted to contact the structure upon partial rotation of the handle.*

*56. A door lock as recited in claim 55, further comprising a plate keyed to the handle, the plate having a shoulder adapted to contact the stationary structure upon partial rotation of the handle.*

*57. A door lock as recited in claim 51, wherein the outside lever handle is longitudinally fixed and rotatably mounted with respect to the rose, the lever handle and rose telescopically locatable along the spindle at a position depending on the thickness of the door.*

*58. A door lock as claimed in claim 51, wherein the spring means comprises*

*a horseshoe-shaped spring having radially deflected ends, the spring circumposing the tubular spindle,*

*and further comprising*

*a radial bracket carried on the handle in the rose, the radial bracket having spaced lugs embracing the radially deflected ends of the spring, and*

*projections means on the rose generally radially aligned respectively with the lugs when the lever handle is in said horizontal disposition, the projection means also embracing the radially deflected ends,*

*the bracket rotating when the handle is turned flexing one end of the spring toward the other end so that when the handle is released the spring returns the handle to a position wherein the longitudinal slot and the radial finger are aligned.*

* * * * *